US006604857B2

(12) United States Patent
Buchanan et al.

(10) Patent No.: US 6,604,857 B2
(45) Date of Patent: Aug. 12, 2003

(54) CONTAINER FOR HOUSING PRODUCT AND METHOD FOR MAKING SAME

(75) Inventors: Jerry E. Buchanan, Acworth, GA (US); Rodney A. Buchanan, Marietta, GA (US); Albert L. Baner, St. Joseph, MO (US); Harold H. Bennett, St. Joseph, MO (US); Todd A. Miles, Huntington Beach, CA (US); John G. Ratcliff, St. Joseph, MO (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 09/941,049

(22) Filed: Aug. 28, 2001

(65) Prior Publication Data

US 2002/0094139 A1 Jul. 18, 2002

Related U.S. Application Data

(60) Provisional application No. 60/228,581, filed on Aug. 29, 2000.

(51) Int. Cl.[7] ..... B65D 33/06

(52) U.S. Cl. ..... 383/6; 383/16; 383/32; 383/93; 383/98

(58) Field of Search ..... 383/121, 98, 93, 383/105, 2, 63, 104, 16, 18, 6, 32, 122, 97

(56) References Cited

U.S. PATENT DOCUMENTS

| | | | | | |
|---|---|---|---|---|---|
| 644,038 | A | * | 2/1900 | Whalley | 383/105 |
| 733,542 | A | * | 7/1903 | Converse | 383/121 |
| 2,128,904 | A | * | 9/1938 | Belcher | 383/106 |
| 2,212,390 | A | * | 8/1940 | Conklin | 383/121 |
| 2,381,026 | A | * | 8/1945 | Arthur | 229/117.32 |
| 2,454,013 | A | * | 11/1948 | Scherzinger | 383/16 |
| 2,481,380 | A | * | 9/1949 | Anderson, Sr. | 229/117.06 |
| 2,746,582 | A | * | 5/1956 | Cart | 190/115 |
| 2,802,617 | A | * | 8/1957 | Roper | 383/119 |
| 3,121,452 | A | * | 2/1964 | Hyman | 150/127 |
| 3,229,741 | A | * | 1/1966 | Ambrose | 383/12 |
| 4,153,146 | A | * | 5/1979 | Patton et al. | 190/103 |
| 4,691,368 | A | * | 9/1987 | Roessiger | 206/526 |
| 5,108,195 | A | * | 4/1992 | Perron | 220/495.11 |
| 5,135,464 | A | | 8/1992 | Buchanan | |
| 5,273,362 | A | | 12/1993 | Buchanan | |
| 5,288,150 | A | * | 2/1994 | Bearman | 383/75 |
| 5,348,398 | A | | 9/1994 | Buchanan | |
| 5,392,589 | A | | 2/1995 | Buchanan | |
| 5,468,206 | A | | 11/1995 | Buchanan | |

* cited by examiner

*Primary Examiner*—Jes F. Pascua
(74) *Attorney, Agent, or Firm*—Bell, Boyd & Lloyd LLC

(57) ABSTRACT

A flexible container and method for making same are provided. the container comprises a base portion including a bottom, side walls, and an interior, the bottom defining a substantially flat planar surface when the container houses product and the container rests on its bottom, an upper panel portion, that is designed to be received within the interior of the base portion and includes side panels that define a closure member, the upper panel being so constructed and arranged to define a substantially flat surface when the closure member is closed and portions of the upper panel are folded over, the upper panel includes a portion that is sealed to the base portion, and a pair of handles may also be coupled to the base portion.

9 Claims, 5 Drawing Sheets

CONTAINER FOR HOUSING PRODUCT AND METHOD FOR MAKING SAME

This application claims the benefit of provisional application No. 60/228,581 filed Aug. 29, 2000.

BACKGROUND OF THE INVENTION

The present invention relates generally to containers for housing a product. More specifically, the present invention relates to flexible containers for housing products.

There are a variety of types of containers for housing products. It is, of course, known to package products in rigid containers such as metal cans, glass bottles, or rigid plastic containers. Rigid containers, when empty, represent a high volume of empty space. As a result, rigid empty containers are cumbersome to ship to the destinations where they will be filled and sealed with product. In addition, such empty containers require significant space for storing and discarding.

It is also known to construct containers from flexible materials, such as sheets or rolls of plastic material. Such flexible containers have been in existence for a number of years. These containers offer many advantages over rigid containers. For example, flexible plastic bottles and cartons offer distinct advantages over metallic cans and glass bottles. In this regard, such flexible containers are lighter, typically far less expensive to produce, and much easier to discard.

However, there are inherent disadvantages with flexible containers. For example, flexible containers do not have the sturdiness of typical rigid containers. The sturdiness of the container can become an issue with respect to the stability of the container when they are filled with product and stood upright for storage, display, or other purpose. Moreover, heavier flexible containers are difficult to pick up and carry conveniently.

To overcome this stability issue, flexible containers have been formed with reinforced bottoms or sides. Such a container is shown in U.S. Pat. No. 5,135,464. In order to create such reinforced enforcements, layers of plastic film or paper are doubled in select locations along or adjacent to the container bottoms as they are manufactured. These double layers are fused by a heat sealing or stitching process. Such constructions, however, result in multiple layers of films or paper being brought together at junctions. In this regard, as many as six layers often meet and are interfused at a seam or junction. This multi-wall construction results in seals that possess a tendency to leak due to capillary action.

An additional problem with many flexible containers is that there is a lack of consistency in the production process. Typically, the manufacturing process associated with such products requires a web of film to be drawn through a series of forming stations where various folds, cuts, or seals are made to the film. In many of these manufacturing processes it is difficult to control and ensure the accuracy and consistency of the resultant product given the number of manipulations to the film and the number of folding, sealing and forming stations. In addition, there are hermetic sealing problems with the multi-wall bags presently available. To this extent, the bags are not "insect-tight" causing problems when the containers are stored with product. Also, the containers are not resealable for storage in-between uses.

A still further problem with flexible containers is their propensity to burst open. This is especially an issue should the container be dropped.

Moreover, another issue with such containers is their shape. Due to the flexible nature of the containers, the containers will take on the shape of the product contained therein and/or a bag-like shape. This makes it difficult to store the filled containers, stack same, and/or package the containers for shipping. Generally, the multi-layer bags have to be stored and displayed in a horizontal flat condition making it difficult to handle the bags. Moreover, it is also difficult to see the labeling on the bags when they are piled on top of each other in the horizontal flat condition.

The lack of stability also causes problems for the user when the user is trying to scoop or pour product from the bag.

Another problem with the current flexible bags is that they are not easily transported after the bags are filled with product at the distribution center or the manufacturing plant or after the filled bags arrive at the point of purchase location. Generally, packaged products are transported via conveyor systems at the manufacturing plant or point of purchase location. Often times, the conveyor systems include sharp turns (e.g., 90° turns) and gaps. The poor stability and awkward size of the large multilayer bags can not maneuver around the turns or through the gaps. As a result, the large multi-layer bags can not be transported on conveyor systems like other packaged products, they must be handled by hand.

There therefore is a need for an improved flexible container for storing and carrying a product, conveniently opening and closing the container and method for making such containers.

SUMMARY OF THE INVENTION

Improved containers and methods for making same are provided. The improved container provides a flexible container that has sufficient stability to be used to house a product. At the same time, the container of the present invention provides the desired flexibility.

To this end, in an embodiment, a flexible container is provided comprising a base portion including a bottom, side walls, and an interior. The bottom defines a substantially flat planar surface when the container houses product and the container rests on its bottom. An upper panel portion is provided that is designed to be received within the interior of the base portion. The upper panel portion includes side panels that define a closure member. The upper panel is so constructed and arranged to define a substantially flat surface when the closure member is closed and portions of the upper panel are folded over. The upper panel includes a portion that is sealed to the base portion.

In an embodiment, the container includes a pair of handles coupled to the base portion.

In an embodiment, each of the pair of handles is bonded to a separate side wall of the base portion.

In an embodiment, the container in a closed position has a substantially cubic-shape.

In an embodiment, the container in a closed position has a triangular shape.

In an embodiment, the pair of handles and upper panel are each thermally sealed to the interior of the base portion.

In an embodiment, the closure member is resealable.

In an embodiment, the closure member includes a ziplock closure.

In an embodiment, the closure member includes a hook and loop closure.

In an embodiment, the closure member includes a zipper closure.

In an embodiment, the closure member includes a cohesive closure.

In an embodiment, the closure member includes an adhesive closure.

In an embodiment, the upper panel portion extends partially below an upper end of the base portion.

In an embodiment, a portion of the handles extends above the upper panel after the container is closed.

In an embodiment, the base includes two triangular sections that each extend from a separate side of the bottom of the base to a lower portion of a side of the container.

In an embodiment, the bottom of the base includes a pair of handles.

In an embodiment, the base includes at least one cavity that extends from a side of the bottom of the base to a lower portion of a side of the container.

In another embodiment of the present invention, a flexible container is provided. The flexible container comprises a base portion including a bottom, side walls, and an interior, the side walls being defined by at least two sheets of flexible material sealed along two edges and defining two seams located on opposite sides of the base. An upper panel portion is provided that is designed to be received within the interior of the base portion and includes side panels that define a resealable closure member. The upper panel defines a substantially flat surface when the closure member is closed. A portion of the upper panel is sealed to the base. The container preferably includes a pair of handles.

In an embodiment, the pair of handles are upper handles and the base portion includes a pair of lower handles. Each lower handle extends from respective corner ends of the bottom of the base portion to a lower portion of a respective side of the container.

In an embodiment, the base includes two triangular portions. Each triangular portion extending from a different side of the bottom to a respective side seam.

In an embodiment, the pair of handles and upper panel are each thermally sealed to the interior of the base portion.

In an embodiment, the closure member includes a hook and loop closure.

In an embodiment, the upper panel portion extends partially below an upper end of the base portion.

In another embodiment of the invention, a method of making a flexible container having a base portion includes providing a flat sheet of plastic material having a width substantially equal to a length of the base portion and indexing the flat sheet in intervals equal to at least a width of the base portion. In addition, the method bonds a pair of handles to the flat sheet. Moreover, a pair of panels are provided and each of the pair of panels is bonded to the flat sheet and one of the pair of handles. Closure means are applied to a free end of each of the pair of panels. The flat sheet, pair of panels and pair of handles are then formed into the flexible container.

In an embodiment, the method of making the container includes applying a peel seal near each end of the flat sheet, each peel seal extending the width of the base portion.

In an embodiment, the method of making the container provides a hermetic seal.

In an embodiment, the method of making of making the container provides the flat sheet of plastic material via a web roll.

In an embodiment, the method of making the container provides a substantially cubic-shaped container.

Accordingly, it is an advantage of the present invention to provide an improved flexible container.

A further advantage of the present invention is to provide an improved method for manufacturing containers.

Another advantage of the present invention is to provide an improved container for storing a variety of different products.

Still, an advantage of the present invention is to provide an improved flexible container that includes an easily resealable closure.

Moreover, an advantage of the present invention is to provide a flexible container that can be stacked after it is filled with product.

Furthermore, an advantage of the present invention is to provide a container that can be easily carried by a consumer.

Another advantage of the present invention is to provide a container that has improved strength characteristics.

Additional features and advantages of the present invention will be described in and are apparent from the detailed description of the presently preferred embodiments and the figures.

DETAILED DESCRIPTION OF THE PRESENTLY PREFERRED EMBODIMENTS

The present invention provides an improved container and method for manufacturing same for housing products. The container is constructed from a flexible material, e.g., thin film of plastic, and has sufficient rigidity and strength to house and store a variety of products. Moreover, due to its construction, the container is stackable.

Figure 1:
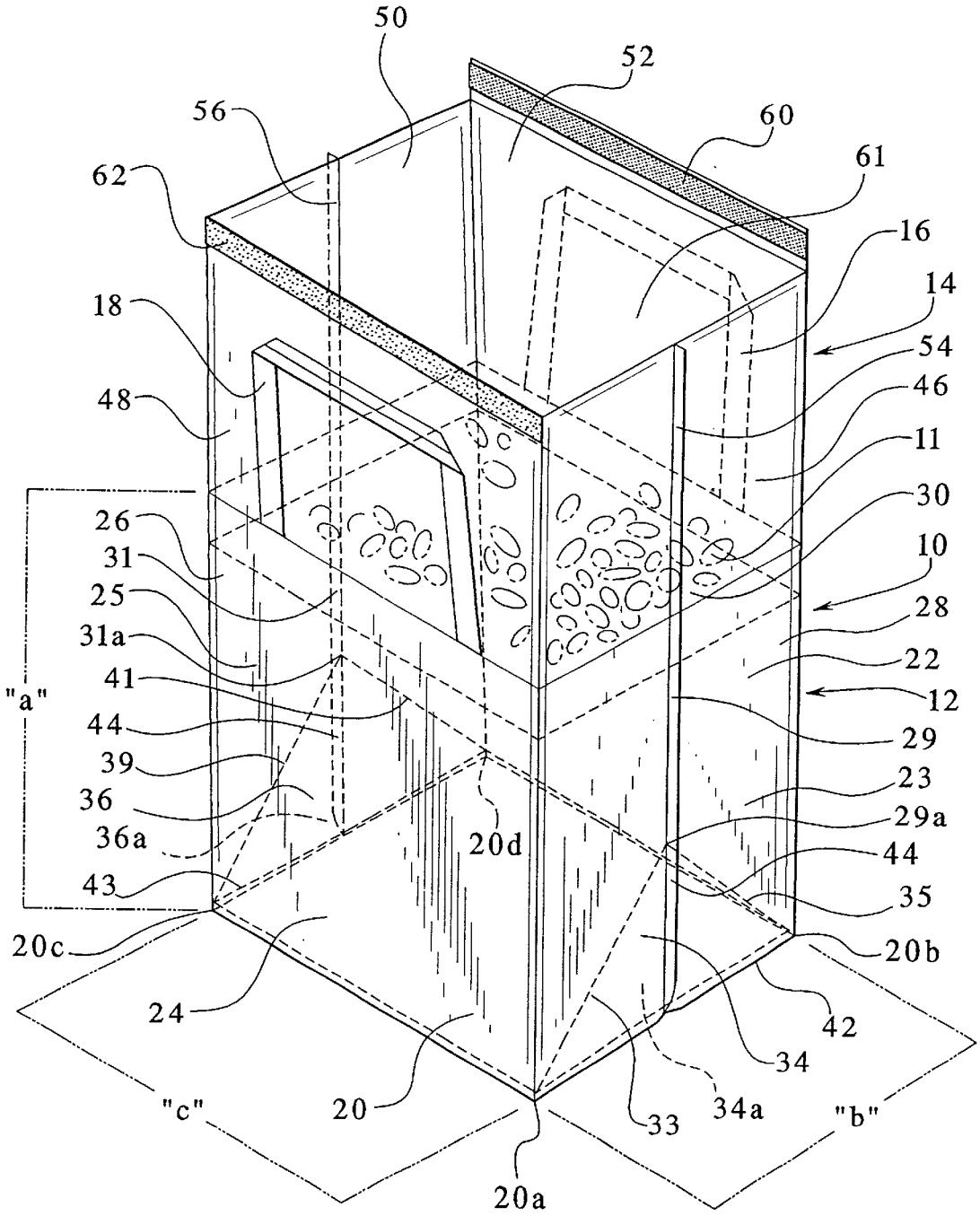
FIG. 1 illustrates a perspective transparent view of an embodiment of the container of the present invention filled with product prior to being sealed.
Figure 6:
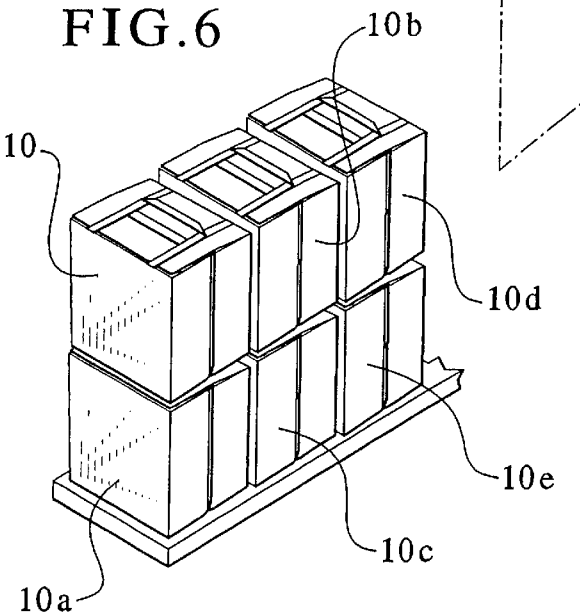
FIG. 6 illustrates a plurality of sealed/closed containers in a stacked position.
Figure 4:
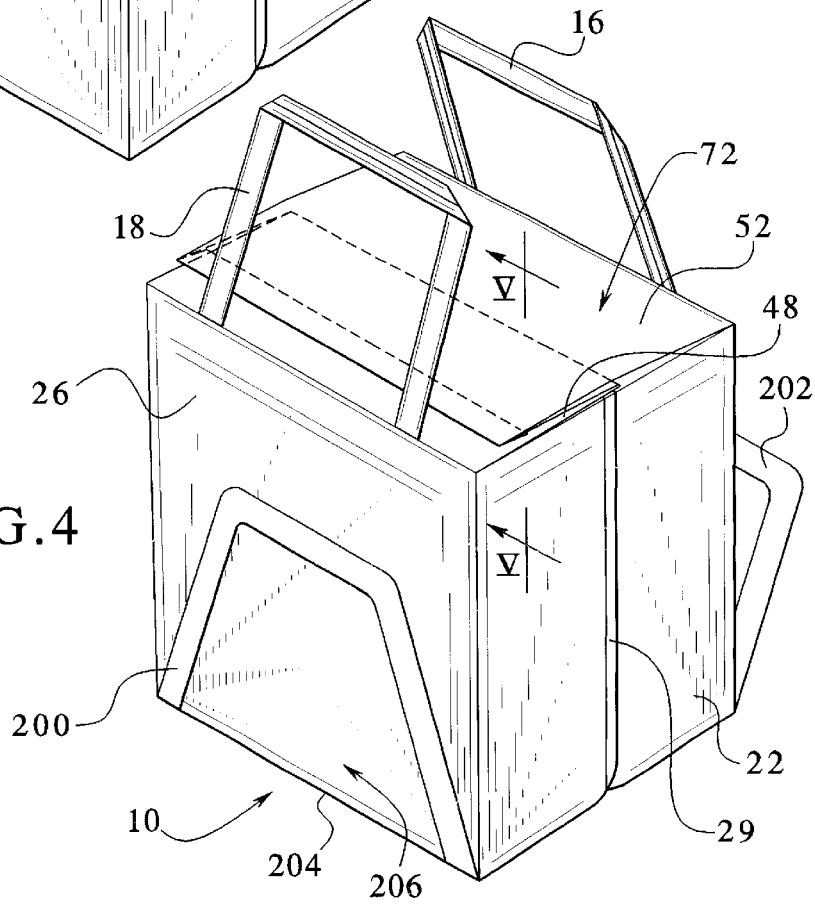
FIG. 4 illustrates a perspective view of the container in a sealed condition ready for storage.

FIG. 1 illustrates a transparent perspective view of an embodiment of a container 10 of the present invention. The container 10 is illustrated filled with product 11 and in an open condition. As illustrated in FIG. 4, in its sealed condition, the container 10 takes on, in a preferred embodiment, a cuboidal shape. The cuboid, e.g., cube-shape, of the flexible container 10 provides a container with greater stability when stored. Moreover, the cuboidal shape of the container 10 allows for vertical stacking of a number of filled containers as illustrated in FIG. 6. This allows for the display of the container/product at the point of sale, as well as provides a container affording ease of storage for the consumer and provides a more compact product for shipping and storage.

Figure 2:
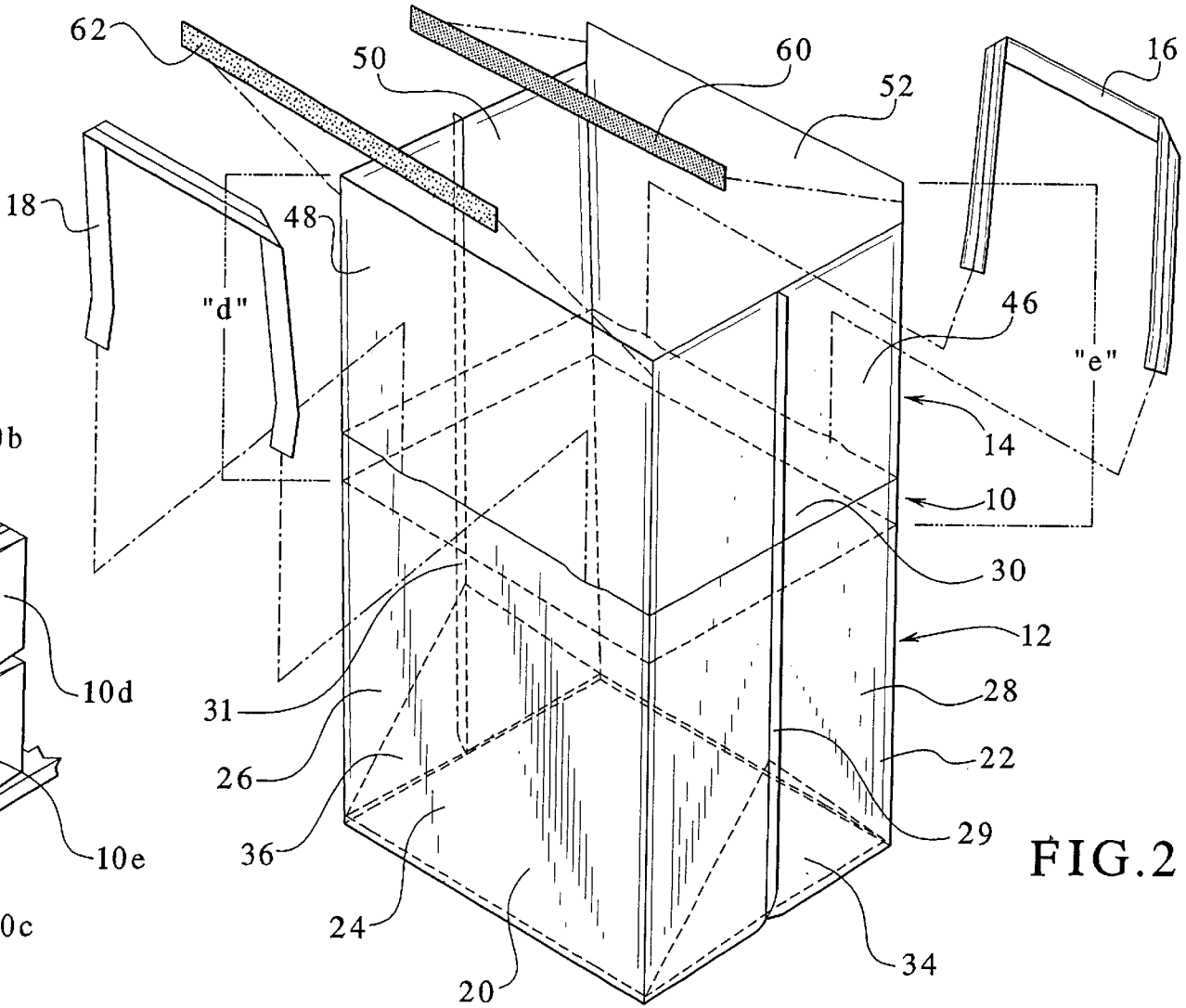
FIG. 2 illustrates a perspective transparent view illustrating separate components of the container prior to being bonded together.

Referring specifically to FIGS. 1 and 2, an embodiment of the container 10 is illustrated. Generally, the container 10 includes three main components: a base portion 12; an upper panel portion 14; and handles 16 and 18. As discussed below, these three components are sealed together to create the container 10. However, the handles are not essential to the formation of the container. As such, other embodiments of the present invention do not include handles.

The base portion 12 includes a bottom 20. The bottom 20 is constructed so that it defines a substantially flat planar surface. The bottom 20 therefore provides a surface that can support product 11 that is stored in the container 10. Moreover, the bottom 20 allows the container 10 to be supported on a flat surface providing stability to the filled container. In an embodiment, the bottom 20 is constructed from a rectangular sheet of material that is thermally sealed to a remaining portion of the base 12.

The base 12, in the preferred embodiment illustrated, includes four sides 22, 24, 26, and 28. The four sides 22, 24, 26, and 28, along with the bottom 20, define an interior 30 for housing product 11. In the preferred embodiment illustrated, the sides 22, 24, 26, and 28 of the base 12 are defined by two sheets of material sealed together along side seams 29 and 31. As illustrated, the side seams 29 and 31 are located on sides 22 and 26 of the base 12.

Triangular base sections or end walls 34 and 36 are formed at a lower portion 23, 25 of each side 22 and 26. Indeed, each of the triangular base sections 34 and 36 are defined by two sealed transitional side seams 33, 35 and 39, 41, respectively. The transitional side seams 33, 35 and 39, 41 extend from end corners 20*a*, 20*b* and 20*c*, 20*d* of the bottom 20 to a vertex 29*a*, 31 a located along the side seams 29 and 31. Each triangular base section having a third side 42, 43 extending between end corners 20*a*, 20*b* and 20*c*, 20*d*, respectively. A lower side seam 44 extends unitarily from vertices 29*a* and 31*a* along side seams 29 and 31 to the third sides 42, 43. This structure results in the lower portions 23, 25 of the container sides 22 and 26 being reinforced along the seams 29 and 31. The resultant seams are free of the presence of the intersection of six converging sealing layers which tends to create capillary leakage as in prior containers. Further, this structure allows for good web control resulting in a highly efficient method of manufacturing containers.

Figure 7:
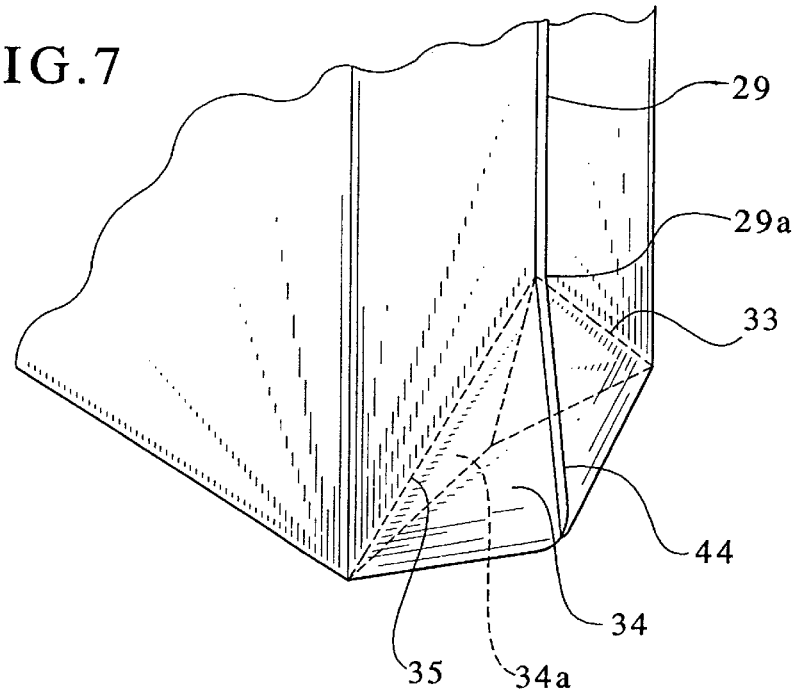
FIG. 7 illustrates a perspective bottom view of a section of the base portion incorporating the "hand-hold" cavity.

As shown in FIG. 7, the base 12 also includes interior triangular base sections 34*a* and 36*a* adjacent the exterior triangular sections 34 and 36. The interior and exterior triangular sections 34*a*, 34 and 36*a*, 36 are compressed together when the container is filled with product. Advantageously, the triangular sections are capable of forming a slightly conical or pyramid shape that provides a "hand-hold" cavity between the interior and exterior triangular sections. In this regard, the "hand-hold" cavity acts as another handle and allows the consumer to pick up the container for ease of pouring or scooping product from the container.

It should be noted, that the base 12 can have a variety of sizes and shapes. For example, for a container 10 designed to house 18 pounds of dry product, e.g., cat food, in a preferred embodiment, the base has a height "a" of approximately 12 inches, sides 22 and 26 have a width "b" of approximately 7 inches, and sides 24 and 28 have a width "c" of approximately 12 inches. For a container designed to house 20 lbs of dry product, e.g., dog food, in a preferred embodiment the base has a height "a" of approximately 12¼ inches, sides 22 and 26 have a length "b" of approximately 9 inches, and sides 20 and 24 have a length "c" of 12 inches.

The base 12, as well as the remaining portions of the container 10, are preferably made of a thin plastic material. For example, the container base 12 can be made from a two-ply construction consisting of a layer of heat sealable polyethylene and a layer of imprintable polyester. Though both layers may be polyethylene. By way of example and not limitation, the material used to construct the container 10, and therefore the base 12, can include a polyethylene ply of 2½ mils and a polyester layer of ½ mil.

Preferably, the container 10 includes two handles 16 and 18. The handles 16 and 18 provide grasping members for carrying the container 10 either prior to the container being filled or after it is filled. Of course, the handles 16 and 18 can take on a variety of shapes and sizes. Moreover, the handles 16 and 18 can be manufactured from a variety of materials suitable for variable load strengths. In a preferred embodiment, the handles 16 and 18, prior to being secured to the container, have a length of 17 inches and are 2-ply thick. In this regard, they are constructed from a web of film that is folded over on to itself to increase the strength of the handles. To this extent, the handles 16 and 18 can be constructed from a single sheet of plastic film.

As illustrated in FIGS. 1 and 2, the container 10 includes an upper panel portion 14. The upper panel portion includes four sides 46, 48, 50, and 52. The upper panel 14, similar to the side wall portion 22, 24, 26, and 28 of the base 12, is constructed from two sheets of material sealed along two seams 54 and 56. In a preferred embodiment, the seams 54 and 56 of the upper panel are in alignment with side seams 29 and 31 of the base 12 when the upper panel 14 is secured to the base 12. In the container 10 illustrated in FIG. 1, the upper panel defines an opening 61 that affords access to the interior of the container 10.

Preferably one of the sides 52, of the upper panel 14, has a length that is slightly greater than that of the other sides 46, 48, and 50. In the illustrated embodiment, this side 52 includes a closure member 60 for assisting in sealing the container 10. The closure member 60 is designed to be secured to a corresponding closure member 62 on side 48.

For example, in the embodiment illustrated, side 52 includes a hook and loop strip 60 that mates with a corresponding hook and loop strip 62 on side 48. This allows the container 10 to be closed and opened in an easy manner. Thus, initially the container 10 can be filled with product 11 through the opening 61 and closed by the closure members 60 and 62. The consumer can then access product through the opening 61 and reclose the container 10 by using the closure members 60 and 62. It should, however, be noted that a variety of closure means and members can be used. For example, the closure can include a zipper, a ziplock or slider structure, or an adhesive or cohesive member.

As previously noted, preferably the upper panel 14 as well as the handles 16 and 18 are constructed from a different material than the base 12.

Similar to the base, the upper panel 14 can have a variety of sizes and shapes. For example, for a container 10 designed to hold 18 lbs of dried products, referring to FIG. 2 in a preferred embodiment of the container 10, the sides 48, 50, and 54 of the upper panel 14 have a length "d" of approximately 7⅜ inches, and side 52 has a length "e" of approximately 8½ inches. The width of the sides of the upper panel 14 will correspond to the width of the corresponding sides of the base 12. For a container 10 designed to hold 20 lbs. of dry product, length "d", in a preferred embodiment, will be approximately 9⅝ inches and length "e" approximately 10¾ inches.

The upper panel 14 is designed to be received within the base 12 In a preferred embodiment, at least approximately 1 inch of the upper panel 14 is received within the base 12. The upper panel 14 is then preferably heat sealed to the base 12. It has been found that a heat seal of at least 1 inch provides a sufficiently strong connection between the upper panel 14 and base 12.

In constructing the container 10, the handles 16 and 18 are preferably received between the upper panel 14 and the base 12. The base 12 is then thermal sealed to the upper panel 14 with the handles 16 and 18 being sealed therebetween. Specifically, the pair of handles 16 and 18 and the upper panel 14 are each thermally sealed unto themselves and to the interior of the base 12. The interior side of the upper panel has a different sealant layer of polyethylene designed for sealing the interior of the containers, yet, allowing ease of opening the container. This provides a sufficiently strong structure as well as one that allows the weight of the contents to be evenly distributed over the base 12. Further, such a structure allows the closure member 60 and 62 located on the upper panel 14 to be closed.

As a result, the base portion 12, the upper panel 14 and the handles 16 and 18 are thermally bonded forming a hermetically sealed interior.

Moreover, the upper panel 14 can be manufactured from a non-slip plastic material. The non-slip plastic material allows the containers to be stacked vertically with limited slippage between the top and bottom containers.

Figure 3:
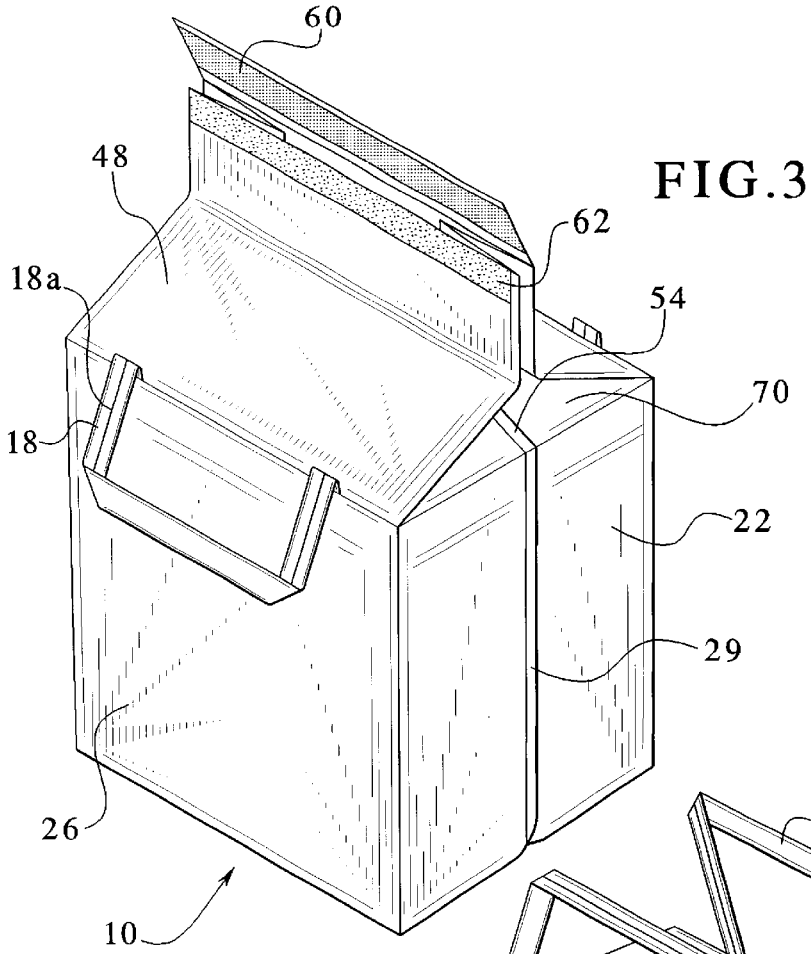
FIG. 3 illustrates a perspective view of the container just prior to the closure members being sealed.
Figure 5A:
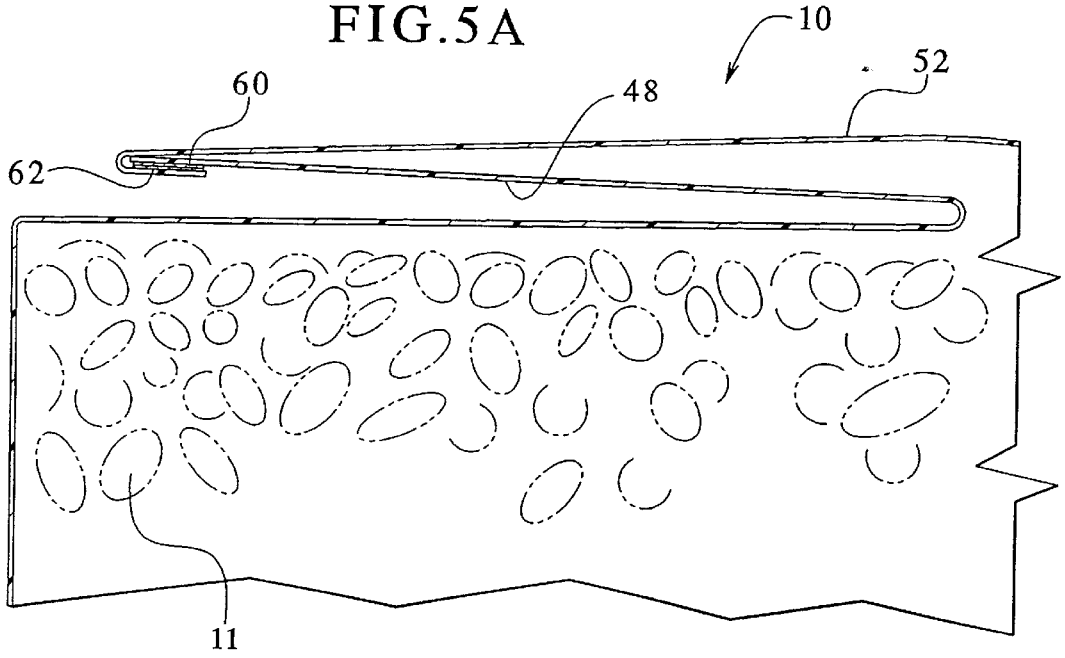
FIG. 5A illustrates a cross-sectional view of the container taken along lines V—V of FIG. 4.

FIGS. 3, 4, 5A and 5B illustrate how the container 10 can be closed. As illustrated in FIG. 3, first the closure members 60 and 62 are secured to each other. When so secured, sides 46 and 50 fold inward to create triangular portions 70. Sides 48 and 52 are then folded over and down onto side 48 as illustrated in FIGS. 4 and 5A. The method of folding the sides in this manner creates a flat top surface 72. Generally, the length of the excess material of the sides 48 and 52 extending from the fold to the closure members may vary depending on the density of the product. Indeed, if the product is very dense then the product will take up less space within the container and vice versa. After the sides of the container are folded down, the sides 48 and 52 are tapped down along the outer fold to further seal the container 10.

Figure 5B:
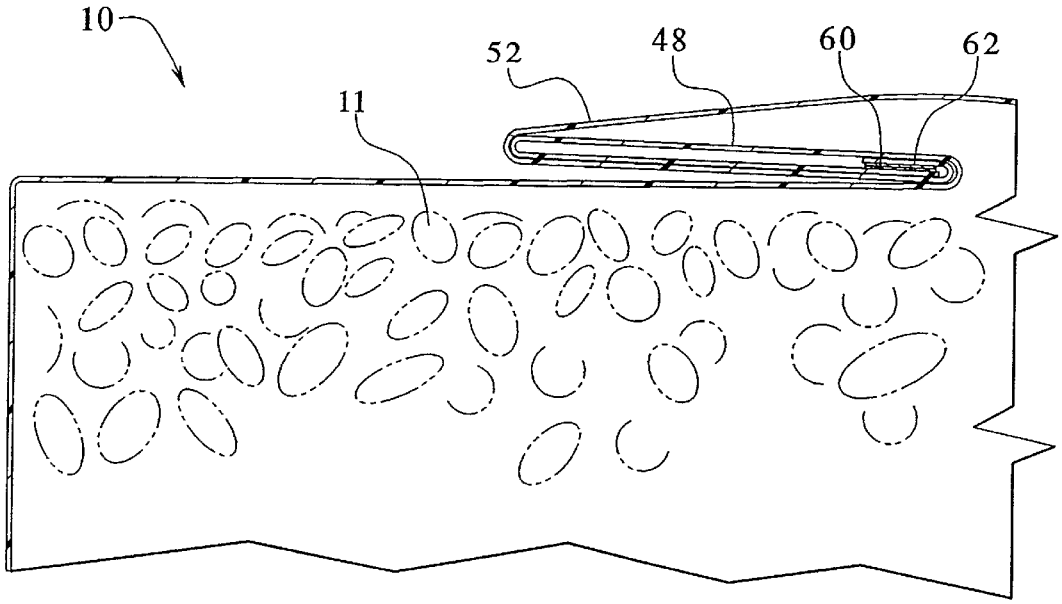
FIG. 5B illustrates a cross-sectional view of an alternative embodiment of the container of FIG. 4 taken along V—V.

Alternatively, FIG. 5B illustrates another way the container can be folded and closed to create the desired flat top surface 72. Specifically, the method shown in FIG. 5B incorporates a double fold in which the sides 48 and 52 are folded twice. The double fold adds even more strength to the top of the container and isolates the closure members 60 and 62. Once so closed, the container 10 takes on a substantially cubic-shape as illustrated in FIG. 4. In an embodiment, the container 10 can include a pair of handles 200 and 202 extending from the bottom 204 of the base portion 206 of the container 10 in addition to the handles 16 and 18 as shown in FIG. 4. It should be appreciated that the container can include any suitable number and type of handle that can be attached to the container at any suitable position and in any suitable manner. The flat bottom 20 and flat top surface 72 allow multiple containers 10, 10*a*, 10*b*, 10*c*, 10*d*, and 10*e* to be stacked vertically or otherwise transported as illustrated in FIG. 6.

Container 10 of the present invention due to its structure also has anti-burst characteristics which are an improvement over those in the prior art. In prior art containers, the dropping of same causes the sides to expand upon impact. This expansion or swell is directly transferred to the inner section of the seams being pulled in the opposite directions. This often results in a breach of the container.

In the present invention, the side seams 29 and 31 of the container 10 extend to the lower side seams 44 which are formed from the transitional seams 33, 35 and 39, 41. As such, should the container be dropped or otherwise caused to expand, the majority of the oppositely disposed forces are placed upon the lower side seam. Thus, should these forces cause one or both of the lower side seams to be pulled apart, this action does not cause a breach in the portion of the container containing the product, whether it be solid pellets or a liquid.

Other embodiments of the invention include containers of various shapes and sizes. For example, a container can be substantially triangular in shape. In this example, the container includes a flat bottom and two sides sealed together. However, the top portion folds down but is not flat as in a cubic-shaped container.

In an embodiment, the method of making the container involves a web roll process that results in a flat blank portion and a forming process that forms the base portion 12 and seals the base portion together. The result being a substantially flat container. After the web roll and forming processes, the flat containers are ready to be erected, filled with product, and sealed closed. Advantageously, the flat containers can be shipped to the manufacturing plant or distribution center where they are erected, filled with product and sealed closed. Of course, the erecting, filling and sealing of the containers can take place at the same location as the web roll and forming processes.

Figure 8:
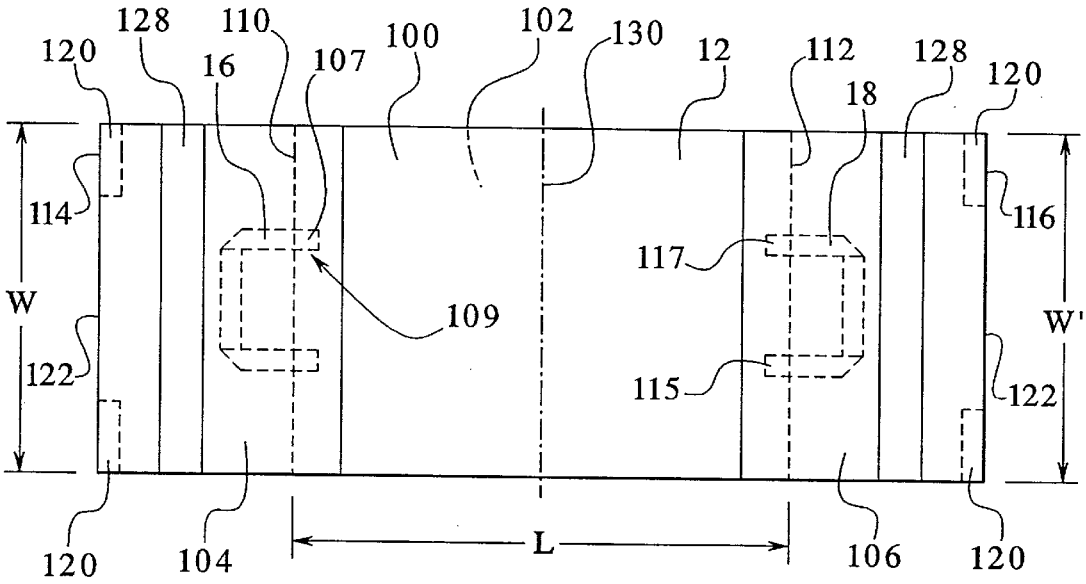
FIG. 8 illustrates a perspective view of a flat blank of the container during the manufacturing process.

Turning to FIG. 8, in the web roll process, a master web roll of plastic material provides the base portion 12. As mentioned earlier, the plastic material is a two-ply construction consisting of, for example, a layer of heat sealable polyethylene and a layer of imprintable polyester.

As the web roll unrolls, a flat sheet of plastic having a width that is approximately a length L of the base portion 12 is provided. This flat sheet may extend for hundreds of feet in length as it is indexed in a progressive mode along the process.

In general, the progressive mode of the process indexes the flat sheet forward at intervals that are at least a width W of the base portion 12. In this example, the polyethylene side (ultimately the interior of the container) of the flat sheet is facing up or on a front side 100 while the polyester side (ultimately the exterior of the container) is facing down or on a back side 102 during the process.

As the flat sheet is indexed the width W of the container, the premade handles 16 and 18 are introduced and thermally bonded at each of the front (polyethylene) side 100 of the base portion 12.

The handles 16 and 18 are also manufactured from a flat sheet of plastic having a width of approximately two inches. (See, e.g., handle 18 in FIG. 3.) Like the flat sheet for the base portion 12, the flat sheet for the handles may also be provided from a web roll. As the flat sheet is unrolled from the web roll, each end of the width of the flat sheet is folded into the center partially overlapping each other so that a seam 18*a* exists down the middle. The seam is then thermally bonded, resulting in a ribbon-like strip. The ribbon is cut to the desired length of the handle. At this time, handles 16 and 18 are each shaped into a U-shape as shown in FIG. 8.

After the handles 16 and 18 are bonded to the base portion 12, the flat sheet is indexed again for the introduction of a left panel 104 and a right panel 106. The panels 104 and 106 will eventually form the upper panel portion 14 of the container. Each of the panels 104, 106 is positioned in line with the width W of the base portion 12. Each panel 104, 106 overlaps a side 110, 112 of the flat sheet. The panels 104, 106 are then thermally bonded to the flat sheet and a side 107 of the handle that is opposite to a handle side 109 that was previously bonded to the base portion 12. In this regard, a hermetic seal is formed due to the bonding process. Additionally, another sealant can be applied at each end 115, 117 of the handles 16 and 18. In this example, the sealant encircles the ends 115, 117 of the handles prior to the introduction of the panels 104, 106.

Next, the flat sheet is indexed forward again. At this point, the closure members 60, 62 (not shown in FIG. 8) can be applied and thermally bonded to the free ends 114, 116 of the left and right panels 104, 106, respectively.

Sections 120 of the free ends 114, 116 are cut-out to form flaps 122. The flaps 122 are designed to be folded one over the other for the closure of the container. As such, the cutout sections 120 may vary depending on the type of closure member that will be used for the container.

In addition, a thin sealant 128 may be applied as a peel seal to the left and right panels 104, 106. Specifically, the thin sealant extends along a width W of the panels 104, 106. The peel seal is a temporary seal that is opened by the user of the product when the user opens the container.

At this point, the flat blank portion continues on to the forming process. Alternatively, the flat blank portion can be formed at a later time or at a different location. In this regard, the flat blank portion is rolled onto a large spindle-type web roll or layered back and forth and placed into a container for storage and shipping.

Generally, the forming process includes forming the base portion of the flat blank, sealing the base portion together and, if desired, folding the bottom of the base portion together so that the container is, once again, substantially flat for shipping or storage. By way of example, U.S. patent application Ser. No. 09/467,125 filed on Dec. 20, 1999, incorporated herein be reference, discloses a manufacturing technique that can be used to form the base portion of the containers of the present invention.

Specifically, the flat blank is indexed forward. As it moves forward, the flat blank is drawn over a v-shaped forming plow and through two rollers causing the flat blank to be folded in half down a center line 130 of the base portion 12 forming a web fold. The resultant folded portion has first and second layers. The first and second layers each have a bottom portion located adjacent the web fold.

Cutouts are formed in the bottom portion of each layer at spaced intervals that extend from each side of the web fold. An upper portion of the first and second layers are heat sealed together forming the eventual side seams 29 and 31 of the finished container 10. The ends of the side heat seals are spaced from and aligned with the cutouts. The bottom portions of the first and second layers are folded upon themselves into two bottom folds. The bottom portions have sections aligned with the upper portion side seals. The bottom portion aligned sections are heat sealed together to form side seal extensions. An area of the bottom portions are heat sealed together adjacent the side seal extensions. The formed flat blank is then severed along the side seals and side seal extensions resulting in individual containers.

As described above, the flexibility of the container 10 of the present invention is advantageous because it can be initially manufactured as a flat structure. To this end, numerous containers can be condensed in a flat, compact state for shipping on pallets, etc., to a second manufacturing plant or distribution center for erecting and filling with product. During this step, the interior cavity 61 of the container 10 is erected, filled with product, sealed, and shipped to the point of purchase or storage.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

We claim:

1. A flexible container comprising:

a base portion including a bottom, side walls, and an interior, the side walls being defined by at least two sheets of flexible material sealed along two edges and defining two side seams located on opposite sides of the base, the base including two triangular portions each triangular portion extending from the bottom to a side seam;

an upper panel portion, that is designed to be received within the interior of the base portion and includes side panels that define a closure member wherein the upper panel portion extends for at least one inch below an upper end of the base portion;

a pair of handles; and the pair of handles and upper panel are each thermally sealed to the interior of the base portion.

2. The flexible container of claim 1 wherein the closure member includes a hook and loop closure.

3. The flexible container of claim 1 wherein the container has a substantially cube-like shape when it is closed.

4. A flexible container comprising;

a base portion including a bottom, side walls, and an interior, the side walls being defined by at least two sheets of flexible material sealed along two edges and defining two side seams located on opposite sides of the base;

an upper panel portion, that is designed to be received within the interior of the base portion and sealed thereto, the upper panel includes side panels that define a resealable closure member, the upper panel defining a substantially flat surface when the container is in a closed position; and a pair of handles wherein the pair of handles are upper handles and the base portion includes a pair of lower handles, each lower handle extending from respective corners of the bottom to a lower portion of a respective side.

5. The flexible container of claim 4 wherein the base includes two triangular portions extending from the bottom to a side seam.

6. The flexible container of claim 4 wherein the pair of handles and upper panel are each thermally sealed to the interior of the base portion.

7. The flexible container of claim 4 wherein the closure member includes a hook and loop closure.

8. The flexible container of claim 4 wherein the up per panel portion extends partially below an upper end of the base portion.

9. A flexible container comprising:

a base portion including a bottom, side walls, and an interior, the bottom defining a substantially flat planar surface when the container houses product and the container rests on its bottom, the base includes two triangular sections that extend from the bottom of the base;

an upper panel portion that is designed to be received within the interior of the base portion and includes side panels that define a closure member, the upper panel being so constructed and arranged to define a substantially flat surface when the closure member is closed and portions of the upper panel are folded over, the upper panel includes a portion that is sealed to the base portion; and a pair of handles coupled to the base portion, each of the pair of handles being bonded to a separate side wall of the base portion wherein the pair of handles and upper panel are each thermally sealed to a part of the interior of the base portion.

* * * * *